US007771295B2

(12) United States Patent
Braun et al.

(10) Patent No.: US 7,771,295 B2
(45) Date of Patent: Aug. 10, 2010

(54) OFF COURT TENNIS

(76) Inventors: Jeffrey S. Braun, 2379 NW. 59th St., Boca Raton, FL (US) 33496; James Wynne, 3 Ridge Rd., Mount Kisco, NY (US) 10549

( * ) Notice: Subject to any disclaimer, the term of this patent is extended or adjusted under 35 U.S.C. 154(b) by 124 days.

(21) Appl. No.: 12/244,910

(22) Filed: Oct. 3, 2008

(65) Prior Publication Data

US 2010/0087278 A1 Apr. 8, 2010

(51) Int. Cl.
*A63B 61/00* (2006.01)

(52) U.S. Cl. ..... 473/494; 473/490

(58) Field of Classification Search ..... 473/467, 473/473, 490, 494

See application file for complete search history.

(56) References Cited

U.S. PATENT DOCUMENTS 3,982,759 A * 9/1976 Grant ..... 473/467
4,004,805 A 1/1977 Chen et al.
4,528,548 A * 7/1985 Oberan ..... 473/467
4,762,990 A 8/1988 Caswell et al.
4,814,986 A * 3/1989 Spielman ..... 700/91
4,894,528 A 1/1990 Diaconu et al.
5,976,039 A * 11/1999 Epel et al. ..... 473/490
6,135,456 A * 10/2000 Cooper ..... 273/371
2002/0122115 A1 * 9/2002 Harmath ..... 348/157

* cited by examiner

*Primary Examiner*—Raleigh W. Chiu
(74) *Attorney, Agent, or Firm*—Robert M. Schwartz; David W. Barman

(57) ABSTRACT

The present invention is an apparatus to provide a virtual tennis net that can be placed on any convenient surface having two movable poles each having a light source dependent thereon; at least two scanning mirrors; at least two retroflectors; at least two beam splitters; at least two photo-detectors; and an audible or visible signal device that is actuated in response to interruptions of light falling on said photo-detectors such that when a the light beam is interrupted by a tennis ball, the beam is momentarily blocked and the signal to the photo-detector is interrupted, providing a signal that is used to trigger a light or sound signal that indicates the ball did not pass over the virtual net.

7 Claims, 3 Drawing Sheets

OFF COURT TENNIS

TECHNICAL FIELD

This invention provides a signal that an object (e.g., a tennis ball) has passed through a defined area of a plane, said signal being used to monitor the progress of a game (e.g. tennis).

BACKGROUND OF THE INVENTION

Scanned light beams have been used for many purposes, e.g., bar code scanners, intrusion detection, touch screens, and laser light shows. In all of these applications, a light source, usually a laser, produces a beam which is scanned by some device, e.g., a rotating mirror or an oscillating mirror. In many of these applications, the beam scans across a well-defined area in a plane, and the interruption of the beam by an object crossing the plane is detected by its effect on the path of the light beam. Typically, the uninterrupted light beam strikes one or more mirrored surfaces that redirect said beam towards a photodetector, producing a steady signal level on said photodetector. Interruption of the beam produces a measurable change on said steady signal, and this change is used to trigger a signal that the beam has been interrupted.

In U.S. Pat. No. 4,762,990, a light beam is swept across an area, reflecting off of mirrors and retro-reflecting material, and the retro-reflected light is directed toward a photodetector. Interruption of the light beam by an object, e.g., a finger or a stylus, is detected by a change in the retroflection signal. The timing of the interruption signal is used to determine the position in the area where the interruption occurred, and this position then serves as an input to a data processing device. Said data processing device may he a computer and said area may be a touch screen terminal used to provide such input.

In U.S. Pat. No. 4,004,805, a pair of collimated light beams aided by a series of mirrors are projected parallel to various boundary lines of a tennis court, and an additional light beam is projected along the top of the net. Said light beams are directed towards photo-detectors, and interruption of the light signal by a tennis bail is detected to indicate that the ball is "out" or has hit the top of the net. Said electronic line monitoring system does not employ scanning nor does it provide any alternative for a traditional tennis net.

In U.S. Pat. No. 4,894,528, a pair of collimated laser beams are projected parallel to the top of a tennis net and directed towards photo-detectors. Said laser beams are positioned to be interrupted by a tennis ball if said ball hits the top of the net, thereby providing an electronic notification of a "let" serve. Said laser beam tennis net "referee" does not employ scanning nor does it provide any alternative for a traditional tennis net.

It is contemplated that the system be configured such that laser exposure does not harm the bodies, especially the eyes, of the users.

The maximum permissible exposure (MPE) is the highest power or energy density (in W/cm2 or J/cm2) of a light source that is considered safe, i.e. that has a negligible probability for creating damage. It is usually about 10% of the dose that has a 50% chance of creating damage under worst-case conditions. The MPE is measured at the cornea of the human eye or at the skin, for a given wavelength and exposure time.

A calculation of the MPE for ocular exposure takes into account the various ways light can act upon the eye. For example, deep-ultraviolet light causes accumulating damage, even at very low powers. Infrared light with a wavelength longer than about 1400 nm is absorbed by the transparent parts of the eye before it reaches the retina, which means that the MPE for these wavelengths is higher than for visible light. In addition to the wavelength and exposure time, the MPE takes into account the spatial distribution of the light (from a laser or otherwise). Collimated laser beams of visible and near-infrared light are especially dangerous at relatively low powers because the lens focuses the light onto a tiny spot on the retina. Light sources with a smaller degree of spatial coherence than a well-collimated laser beam lead to a distribution of the light over a larger area on the retina. For such sources, the MPE is higher than for collimated laser beams. In the MPE calculation, the worst-case scenario is assumed, in which the eye lens focuses the light into the smallest possible spot size on the retina for the particular wavelength and the pupil is fully open. Although the MPE is specified as power or energy per unit surface, it is based on the power or energy that can pass through a fully open pupil (0.39 cm2) for visible and near-infrared wavelengths. This is relevant for laser beams that have a cross-section smaller than 0.39 cm2. The IEC-60825-1 and ANSI Z136.1 standards include methods of calculating MPEs.

SUMMARY OF THE INVENTION

The invention provides a virtual tennis net that may be placed on any surface, e.g., a driveway, a lawn, a playground, and the like, in order to establish an aerial zone where a tennis ball is considered to have "hit the net" when it passes through said virtual net. Upon passing through said aerial zone, an audible and/or visible signal occurs, alerting the players that the point is over. The virtual tennis net consists of two poles to be placed at the two sides of the playing surface, with a retractable cord stretched between the tops of the poles to indicate the top of the net.

One pole (pole "L" for lower light source) contains a low power laser which is aimed to strike a rotating or oscillating mirror located at the base of the same pole, said mirror serving to scan the laser beam across the aerial zone representing a portion of the virtual net. The second pole (pole "U" for upper light source) is lined with a retroreflecting material, e.g. retroreflecting tape, which reflects light striking it anti-parallel to the input beam, independent of the angle of incidence. Thus, when the laser beam is incident on the retroreflecting tape, anywhere along the pole, the light is reflected back towards the rotating/oscillating mirror and thence toward the laser. Placed between the rotating/oscillating mirror and the laser is a beam splitter, which reflects some of the retroreflecting beam towards a photodetector. Said photodetector is attached to a standard amplifier and speaker or light source, with a standard electronic circuit that will cause the speaker to emit a sound or the light source to turn on when the laser beam is interrupted by a tennis ball passing through the scanned aerial zone of the virtual net. This combination of laser, scanning minor, retroreflecting tape, and photodetector constitutes a partial virtual net of triangular cross section, covering essentially one-half (½) of the area of the total virtual net.

The complementary triangular cross section, completing the coverage of the rectangular cross section of the entire virtual net, is realized by using a second set of elements, identical to those just described, but placed in different positions. Pole "U" contains a low power laser which is aimed to strike a rotating or oscillating mirror located at the top of the same pole, said minor serving to scan the laser beam across the aerial zone representing the virtual net. Pole "L" is also lined with a retro-reflecting material, which reflects light striking it anti-parallel to the input beam, independent of the angle of incidence. The retro-reflected beam of light is incident on a beam splitter, which reflects some of the retro-reflected beam towards a photodetector attached to an electronic circuit that will emit an audible and/or visible signal when the laser beam is interrupted by a tennis ball passing through the scanned aerial zone of the virtual net. Together, these two distinct and complementary optical/electronic circuits constitute a virtual rectangular net.

While the poles may be placed at a separation corresponding to the standard width of a singles or doubles tennis court, they may also be placed at any other separation, allowing a narrower width for practicing certain tennis shots, e.g. "down the line" shots or "passing" shots, where precision location or "placement" is what is being practiced.

A tennis ball traveling at high speed, e.g., a fast serve, travels as fast as 150 mph, or 6600 cm/sec. The diameter of a tennis ball is approximately 10 cm, so a ball traveling at this speed crosses the plane of the virtual net in 1.5 msec. Thus the scan rate of the laser beams has to be in excess of 667 scans/sec to ensure that the ball actually interrupts the laser beam as it passes through the virtual net while that laser beam is scanning. Such scanning rates are easily achieved with light weight rotating or oscillating mirrors, such as those used in commercial laser bar code scanners or laser light shows.

DETAILED DESCRIPTION OF THE PREFERRED EMBODIMENT

Figure 1:
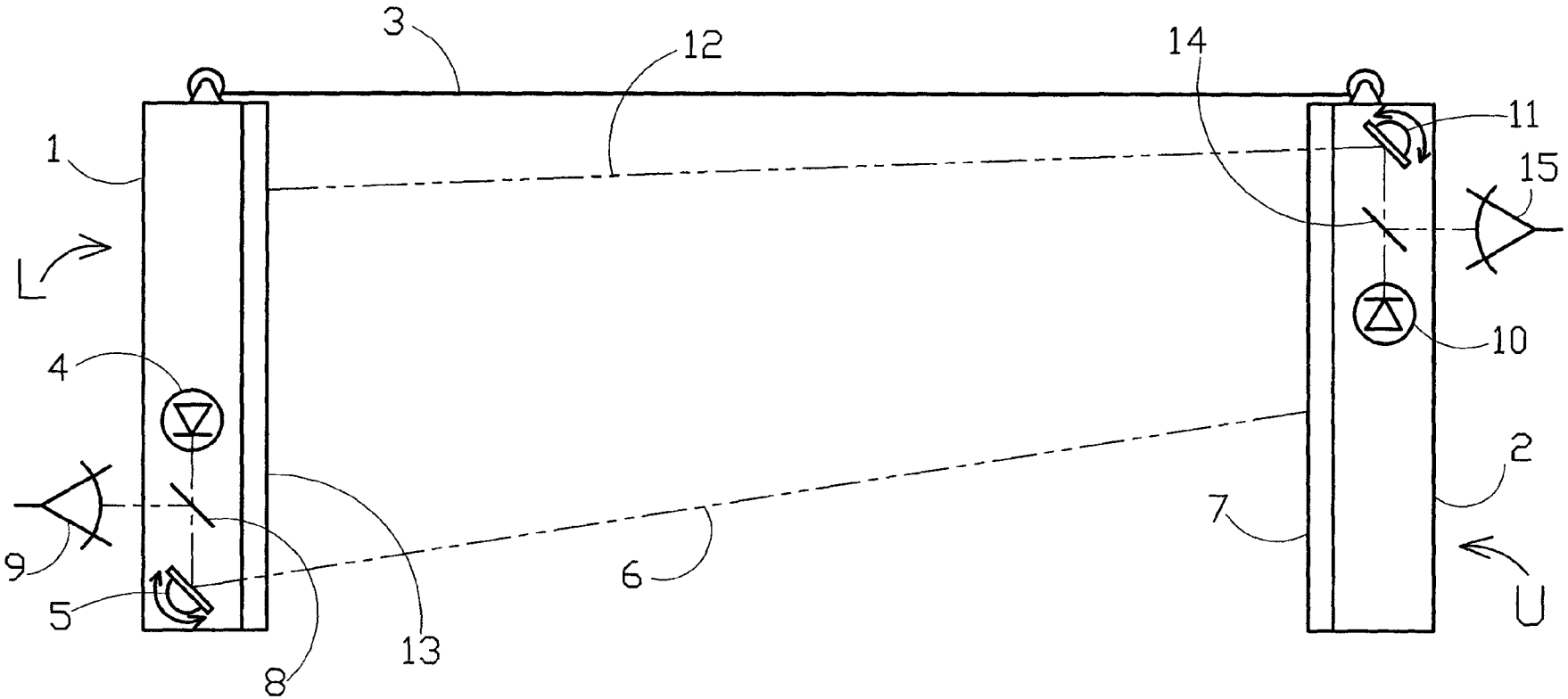
FIG. 1 is a schematic view of the invention, illustrating the relative position of the components.

The system of the present invention has a first pole 1 and second pole 2. For illustrative purposes only, first pole 1 is on the left in the accompanying figures and second pole 2 is on the right. Retractable string or tape 3 is placed between the tops of said first pole 1 and second pole 2. Pole 1 has attached a first light source 4 that emanates a beam 6 through a first beam splitter 8 with a portion of beam 6 directed to a first mirror 5. Pole 2 has attached a second light source 10 that emanates a beam 12 through a second beam splitter 14 with a portion of beam 12 directed to a second mirror 11. Pole 1 has reflective material 13 on its outer surface. Pole 2 has reflective material 7 on its outer surface. Triangular region 16 is defined by a first triangular side along the edge of pole 1, a second triangular side along string 3 from pole 1 to pole 2, and a hypotenuse extending from the base of pole 1 to the top of pole 2. Triangular region 17 is defined by a first triangular side along the edge of pole 2, a second triangular side extending from the base of pole 1 to the base of pole 2, and a hypotenuse extending from the base of pole 1 to the top of pole 2, such that each of regions 16 and 17 share a common hypotenuse.

Referring to FIG. 1, a schematic view of the invention is provided illustrating the relative positions of all of the optical elements as well as the physical poles on which, the optical elements are mounted. In FIG. 1, the "L" pole 1 is placed in the desired position on any playing surface, the "R" pole 2 is placed relative to pole 1 on the playing surface at any desired position and separated from pole 1. A retractable string or tape 3 is stretched between the top or a region near the top of pole 1 and the top or a region near the top of pole 2. String 3 corresponds to the top edge of the virtual net. Poles 1 and 2 may be any height, but are typically the height of standard posts supporting a standard tennis net. According to the American Tennis Federation, the poles are a height of 3.5 feet and the net 3 feet high at the center. String 3 may be white or any other color so as to be visible to the participants using the virtual net.

A light source 4, such as a laser, emits a beam of light that is incident on rotating or oscillating mirror 5, so that the reflected light beam 6 sweeps across a plane corresponding to a portion of the virtual net. Beam 6 is retro-reflected from a material 7 that lines the surface of pole 2, such as retro-reflecting tape, causing beam 6 to be retro-reflected back along the path of incidence so as to reflect from mirror 5 back towards the light source 4. Partially reflecting mirror 8, also commonly known as a beam splitter, reflects a portion of the retro-reflected beam 6 onto the photodetector 9. While beam 6 is incident onto any portion of retro-reflecting material 7, it produces a relatively steady electronic signal level from photodetector 9. The area swept across by beam 6 is triangular in shape and corresponds to the lower right triangular portion of the complete rectangular virtual net. When a tennis ball passes through this triangular portion, the light incident on photodetector 9 is interrupted. The electronic signal produced by photodetector 9 is markedly reduced, and this signal change may be detected by standard electronic circuitry to actuate and create an audible or visible signal indicating that the ball has not cleared the virtual net.

Similarly, a light source 10 emits a beam of light that is incident on rotating or oscillating mirror 11, so that the reflected light beam 12 sweeps across a plane corresponding to a portion of the virtual net. Beam 12 is retro-reflected from a material 13 that lines the surface of pole 1, causing the beam to be retro-reflected back along the path of incidence, then reflected from mirror 11 back towards the light source 10. Partially reflecting mirror 14 reflects a portion of the retro-reflected beam 12 onto the photodetector 15. The area or region 16, swept across by beam 12 is triangular in shape and corresponds to the upper left triangular portion of the complete rectangular virtual net. When a tennis ball passes through triangular region 16, the light incident on photodetector 15 is interrupted, the electronic signal produced by photodetector 15 is markedly reduced, and this signal change may be detected by standard electronic circuitry to actuate the apparatus and create an audible or visible signal. Triangular region 17, covered by the sweep of beam 12 is the complement of triangular region 16 covered by the sweep of beam 6, and, together, these two beams completely sweep across a rectangular area, establishing a virtual net under the string 3.

Figure 2:
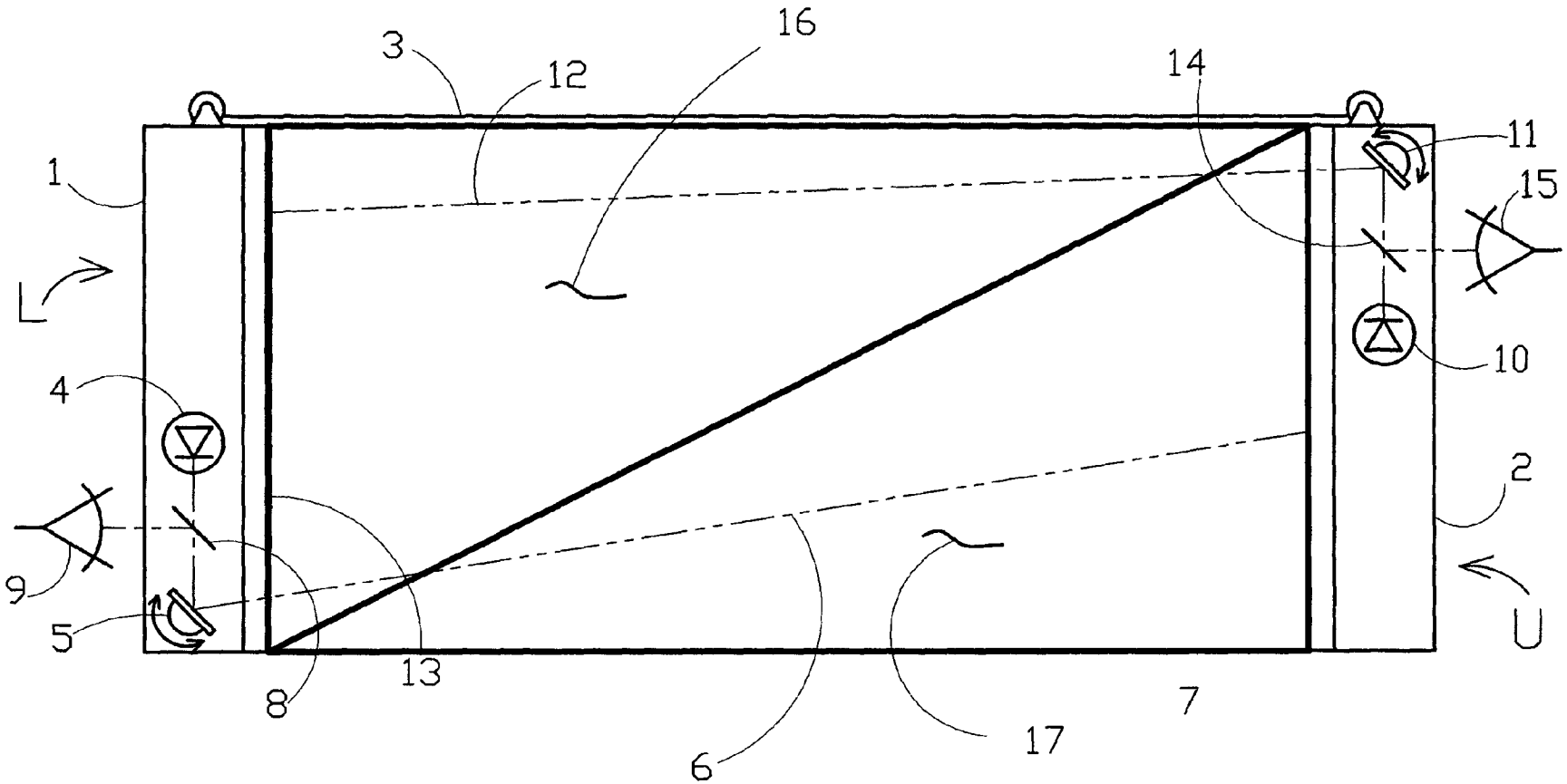
FIG. 2 is a diagram indicating the triangular areas of the virtual net swept across by the complementary beams of light.

FIG. 2 provides a more explicit diagram of the areas covered by the sweeps of beams 6 and 12. Region 16 is the triangular region covered by the sweep of beam 6, while region 17 is the triangular region covered by the sweep of beam 12.

Figures 3A, 3B:
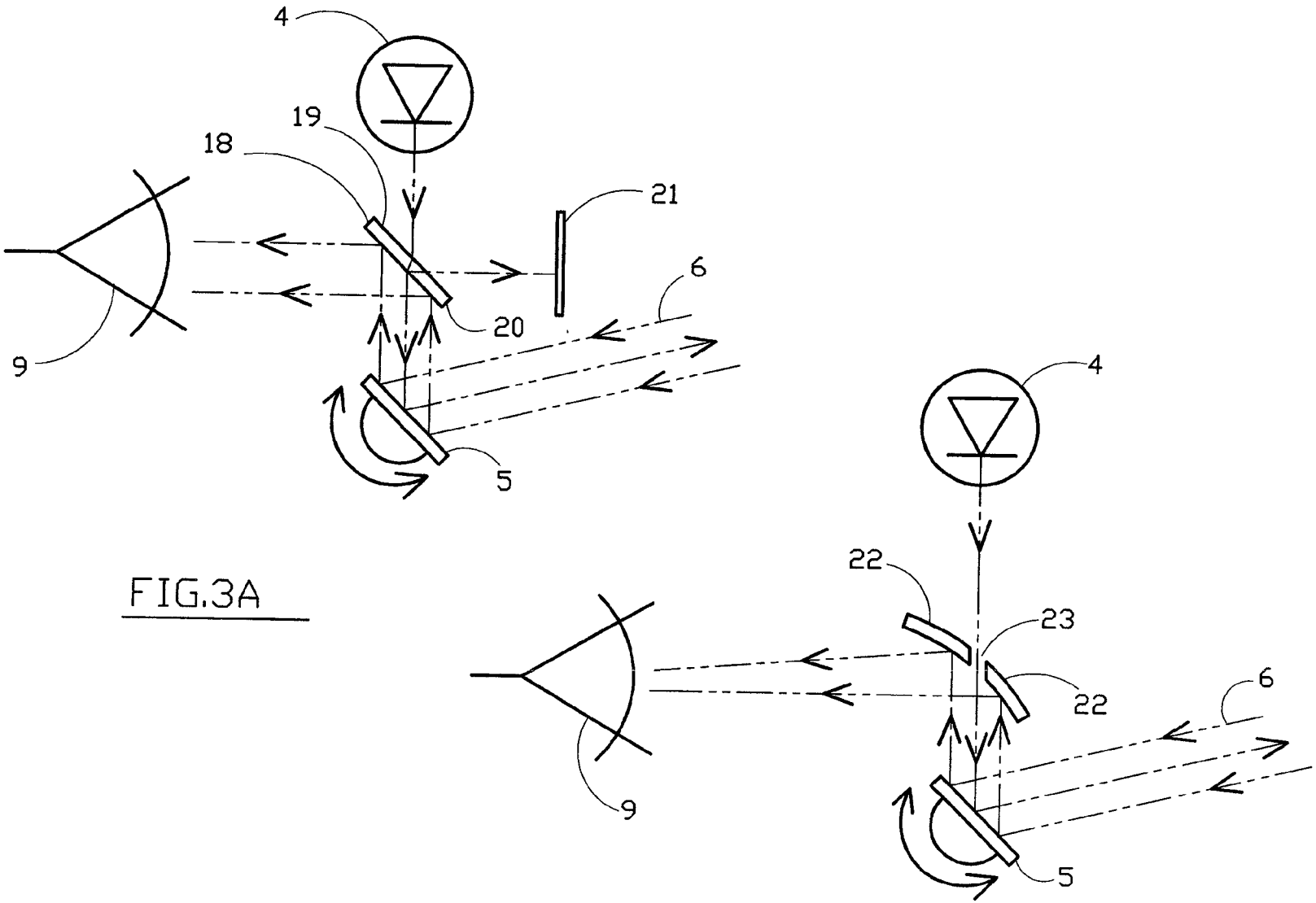
FIG. 3A illustrates one structure for splitting off a portion of the retro-reflected beam of light and directing it onto a photodetector.
FIG. 3B illustrates a second structure for splitting off a portion of the retro-reflected beam of light and directing it onto a photo detector.

Referring to FIGS. 3A and 3B, beam splitting mirror 5 (along with the light source and photodetector contained in pole "L") is described in more detail.

FIG. 3A depicts a partially-reflecting beam splitter 18 consisting of a plate of material (e.g. glass or plastic) that is transparent to the wavelength of the light source. The beam from the light source 4, located in one pole, is incident on the first surface 19 of splitter 18, which has an anti-reflection (AR) coating; hence no light is reflected from this surface. The beam enters splitter 18 and is transmitted to the second surface 20, which has a coating that reflects 50% and transmits 50% of the light. The reflected portion of the beam comes back out through the first surface and is blocked by a light absorbing baffle 21, so that it will not produce any spurious signal on the detector. The transmitted portion of the beam then follows the path 6 depicted in FIG. 1. Following retro-reflection from material lining the other pole, the returning beam is incident on mirror 5, which reflects it to the second surface 20 of the beam splitter 18, which reflects 50% of this beam to the photodetector 9

Referring to FIG. 3B, an enhancement of retro-reflected light detection is illustrated. In FIG. 3B, a structure is provided for splitting off, focusing, and sensing the light returned from the mirror 5. Instead of a partially-reflecting beam splitter, an arc-shaped reflector 22 with a central opening 23 serves the function of permitting the entire narrow incident beam from the light source 4 to pass through the opening 23. This transmitted beam follows the path depicted in FIG. 1. Following retro-reflection from the material lining the other pole, the returning beam, which has widened significantly in cross section, is reflected from mirror 5 onto arc-shaped reflector 22, which reflects all of this returning beam, except for the small portion that passes through the opening 23. Due to the concave shape of reflector 22, the reflected light is converged onto photodetector 9.

It will be apparent to one skilled in the art, in the light of the principles set forth, that many substitutions and refinements will be readily apparent to one skilled in the art that encompass alternative embodiments. The retro-reflecting material may be tape or some other combination of glass or plastic beads that retro-reflect a significant portion of light incident upon the material. Since this material is retro-reflecting, it is not critical that the poles 1 and 2 be positioned at exact rotation angles around vertical axis of the poles. It is only necessary that beam 6 strike retro-reflecting material 7 somewhere along the length (height) and width of this material on pole 2, and it is only necessary that beam 12 strike retro-reflecting material 13 somewhere along the length (height) and width of this material on pole 1. The power of the laser beams emitted by light sources 4 and 10, while low enough to satisfy the Bureau of Radiological Health requirement that the beam is not dangerous to the human eye even when aimed directing into the human eye, is still strong enough to easily register a significant and measurement photo-signal on photo-detectors 9 and 15. Further these beams may scatter significantly from dust and water vapor droplets to be visible to participants when the game is played under low ambient light levels, making it possible to play this game in the evening without additional peripheral lighting.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. An apparatus to provide a virtual tennis net that can be placed on any convenient surface comprising:

(a) two movable poles each having a light source dependent thereon;

(b) at least two scanning mirrors;

(c) at least two retro-reflectors;

(d) at least two beam splitters;

(e) at least two photo-detectors; and (f) an audible or visible signal device that is actuated in response to interruptions of light falling on said photo-detectors.

2. The apparatus of claim 1 wherein said light beams are provided by semiconductor diode lasers.

3. The apparatus of claim 1 wherein said light beams in each moveable pole are retro-reflected from retro-reflecting tape attached to said moveable poles.

4. The apparatus of claim 1 wherein the top of said virtual net is established by a retractable string or tape stretched from at or near the top of said first pole to the top of said second opposite pole.

5. The apparatus of claim 1 wherein the separation distance between said first movable pole and said second movable pole is adjustable so as to provide a standard width virtual tennis net or a narrow net width for the purpose of practicing particular tennis strokes for accuracy of placement.

6. The apparatus of claim 1 wherein said light beams are visible in low ambient light.

7. The apparatus of claim 1 wherein the virtual net can be set up in front of a wall.

* * * * *